US009939239B1

(12) United States Patent
Manole et al.

(10) Patent No.: US 9,939,239 B1
(45) Date of Patent: Apr. 10, 2018

(54) STACKABLE COLLABORATIVE ENGAGEMENT MUNITION

(71) Applicants: Leon Manole, Great Meadows, NJ (US); Mark Young, Mt. Arlington, NJ (US)

(72) Inventors: Leon Manole, Great Meadows, NJ (US); Mark Young, Mt. Arlington, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 512 days.

(21) Appl. No.: 14/267,091

(22) Filed: May 1, 2014

Related U.S. Application Data

(60) Provisional application No. 61/819,002, filed on May 3, 2013.

(51) Int. Cl.
*F42B 5/03* (2006.01)
*F42B 12/58* (2006.01)
*F42B 12/34* (2006.01)

(52) U.S. Cl.
CPC ..... *F42B 12/34* (2013.01); *F42B 5/035* (2013.01)

(58) Field of Classification Search
CPC .. F42B 5/03; F42B 5/035; F42B 12/58; F42B 12/60
USPC ..... 102/489, 506, 393, 482, 502, 501, 389, 102/384, 385, 438, 382, 494; 244/3.11, 244/3.15
See application file for complete search history.

(56) References Cited

U.S. PATENT DOCUMENTS 3,916,794 A * 11/1975 Mayer ..... F42B 12/58 102/489
4,488,489 A * 12/1984 Schoffl ..... F42B 12/58 102/350
4,726,297 A * 2/1988 Bueno ..... F42B 12/62 102/357
5,076,171 A * 12/1991 Altenau ..... F42B 12/62 102/334
5,277,116 A * 1/1994 Axinger ..... F42B 10/50 102/388
7,210,410 B1 * 5/2007 Widener ..... F42B 7/02 102/438
7,314,006 B1 * 1/2008 Georgantzis ..... F42B 5/145 102/498
7,494,090 B2 * 2/2009 Leal ..... F41G 3/04 102/473
7,836,828 B2 * 11/2010 Martikainen ..... F42B 7/04 102/458
8,115,149 B1 * 2/2012 Manole ..... F42B 10/18 102/430

(Continued)

*Primary Examiner* — Reginald Tillman, Jr.
(74) *Attorney, Agent, or Firm* — John P. DiScala

(57) ABSTRACT

A stacked, collaborative engagement ammunition round is presented. The round includes plural stacked miniaturized projectiles where such projectiles separate after launch and then swarm as a group towards a target or targets. At launch, the projectiles may fly in a preselected formation, leader-follower towards the target. Or, the projectiles may deploy propellers, tri-copter or quad-copter vanes, and self steer swarming to the target. Each projectile has its own miniaturized guidance, navigation and control components, autopilot, cameras, transmitter, receiver, antennae, power source, sensors, fuzes and/or flex circuits.

13 Claims, 6 Drawing Sheets

(56) References Cited

U.S. PATENT DOCUMENTS 8,119,957 B2 * 2/2012 Wich ..... F41G 7/007 244/3.1
8,371,201 B2 * 2/2013 Deflumere ..... F41H 11/02 89/1.11
8,434,920 B2 * 5/2013 Jones ..... B64C 39/024 362/233
8,575,526 B1 * 11/2013 Colvin ..... F41G 7/308 244/3.1
8,783,155 B2 * 7/2014 Green ..... F41A 1/06 102/360
8,985,025 B1 * 3/2015 Manz ..... F42B 12/58 102/489
9,068,807 B1 * 6/2015 Thomas ..... F42B 15/10 102/370
9,587,922 B2 * 3/2017 Kalifa ..... F42B 14/064
2003/0226467 A1 * 12/2003 Nardone ..... F41G 7/2233 102/489
2007/0056460 A1 * 3/2007 O'Dwyer ..... F42B 5/035 102/374
2008/0307994 A1 * 12/2008 Gustafsson ..... F41H 11/02 102/489
2009/0000465 A1 * 1/2009 Deflumere ..... F41H 11/02 89/1.11
2009/0120317 A1 * 5/2009 Bishop ..... F41A 1/02 102/438
2009/0241796 A1 * 10/2009 Bambach ..... F42B 5/035 102/438
2010/0282110 A1 * 11/2010 Sexton ..... F42B 10/48 102/438
2012/0234966 A1 * 9/2012 Biswell ..... F41G 3/04 244/3.16
2013/0047880 A1 * 2/2013 O'Dwyer ..... F42B 5/035 102/438
2016/0102953 A1 * 4/2016 Kalifa ..... F42B 14/064 102/521

* cited by examiner

STACKABLE COLLABORATIVE ENGAGEMENT MUNITION

CROSS REFERENCE TO RELATED APPLICATIONS

This application claims benefit under 35 USC 119 (e) of the filing date of provisional application Ser. No. 61/819,002 filed May 3, 2013 by the same inventors, entitled "Stackable Collaborative Engagement Munitions", the entire file wrapper contents of which application are hereby incorporated by reference as though fully set forth.

U.S. GOVERNMENT INTEREST

The inventions described herein may be made, used, or licensed by or for the U.S. Government for U.S. Government purposes.

BACKGROUND AND BRIEF SUMMARY OF INVENTION

Currently, military projectiles are manufactured to be fired and have a single use objective. The objective may be to provide smoke, pyrotechnic illumination, to deliver cargo or to defeat/destroy a target. New technology in miniaturization of guidance, navigation and control (GN&C) components, autopilots, cameras, transmitters, receivers, antennae, power sources, sensors, fuzes and flex circuits allow the manufacture of munitions/projectiles. Such projectiles can then be made into a single round, with such projectiles stackable or nested, and can be made to fulfill more than one objective. Such projectiles separate in flight. Each projectile has the capability to function on its own after separation while in-flight. Projectiles, such as 40 mm to 155 mm for instance, may be stacked into one unit and fired as a single round. Upon gun exit, the projectiles come apart with each stacked projectile having its own guidance, navigation and control (GN&C) components, autopilots, cameras, transmitters, receivers, antennae, power sources, sensors, fuzes and/or flex circuits. Such projectiles would now be able to fulfill more than one function. And as an example, the projectiles could be made to work as a collaborative engagement munition, and swarm towards a target.

OBJECTS OF THE INVENTION

Accordingly, it is an object of the present invention to provide a collaborative engagement ammunition round which includes plural stacked miniaturized projectiles therein.

Another object of the present invention is to provide an ammunition round having plural stacked miniaturized projectiles therein which separate after launch and then swarm as a group towards a target.

It is a further object of the present invention to provide an ammunition round with dispersing plural projectiles that fly in a preselected formation, leader-follower, swarming towards a target.

It is yet another object of the present invention to provide an ammunition round with dispersing plural projectiles that deploy tri-copter or quad-copter vanes, and self steer swarming towards a target.

It is a still further object of the present invention to provide an ammunition round with dispersing plural projectiles, where each projectile has its own miniaturized guidance, navigation and control components, autopilot, cameras, transmitter, receiver, antennae, power source, sensors, fuzes and/or flex circuits.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION

Figure 1:
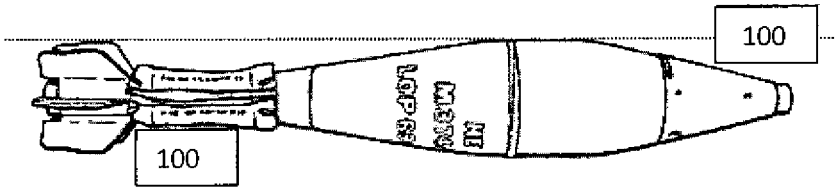
FIG. 1 illustrates an outline of a common 60 mm mortar projectile.

FIG. 1 is a depiction of a standard 60 mm mortar (100). When fired from a mortar gun tube such projectile travels on a ballistic path and might deliver either smoke, illumination, detonation, fragments, warhead or cargo. Such is typical for all projectiles from 40 mm to 155 mm. Some projectiles have guidance and control features added to them to improve probability of hit. Provided here is a projectile that contains such individual components but which are stacked as a unit into a single round. Each stacked projectile can separate from the main round and perform its own mission, or, projectiles can swarm together as a collaborative munition, to defeat a single target (or even multiple targets). Provided also is an ability for these stacked projectiles to transform and each to have its own propulsion system, so groups of projectiles can attack as a swarm, and at great distances. It is also provided that several of these stacked projectiles, fired at the same time from different guns, can separate from their main rounds, and each perform its own mission, or again, swarm together as a collaborative munition to defeat a single target. Such projectiles can have algorithms programmed into their autopilots or control systems to work together as a leader-follower, or have real time camera systems broadcasting back to a user who can even select or change targets real time during flight. New technology in miniaturization of guidance, navigation and control (GN&C) components, autopilots, cameras, transmitters, receivers, antennae, power sources, sensors, fuzes and flex circuits may allow the manufacture of such munitions/projectiles that are stackable or nested. Projectiles, such as 40 mm to 155 mm for example, may be stacked into one unit and fired as a single round. Upon gun exit, the projectiles come apart with each stack projectile having its own guidance, navigation and control (GN&C) components, autopilots, cameras, transmitters, receivers, antennae, power sources, sensors, fuzes and/or flex circuits, e.g. Such projectiles would now be able to work as a collaborative engagement munition and swarm towards a target. The projectiles may be controlled by a user, for instance, through a computer, a PDA or other small device. Such can also be preprogrammed to swarm a single target or swarm to attack multiple targets. Each stackable munition projectile contains its own camera and broadcast system. A user can direct each projectile by line of sight or by real time video on a computer or an autopilot, or each projectile can be preprogrammed with target identification, a way point navigation, or a GPS location. The stackable projectile, once it comes apart, may have the potential to retain shape, or transform into a UAV, or a tri-copter or a quad-copter. Those projectiles would then be self propelled and can swarm a target or several targets, as directed by a user. And, such devices can carry the same payloads as regular projectiles whereas currently, gun fired projectiles 40 mm to 155 mm for instance, are manufactured to perform only a single mission as was mentioned.

Figure 2:
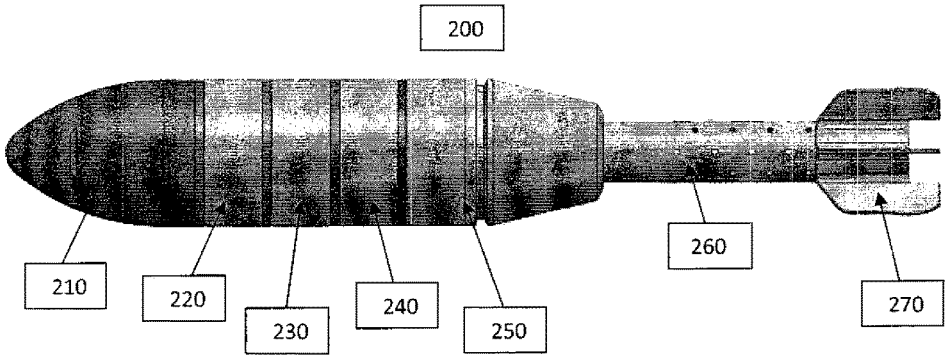
FIG. 2 illustrates a stackable munition with collaborative engagement stacked projectiles according to this invention.
Figure 3:
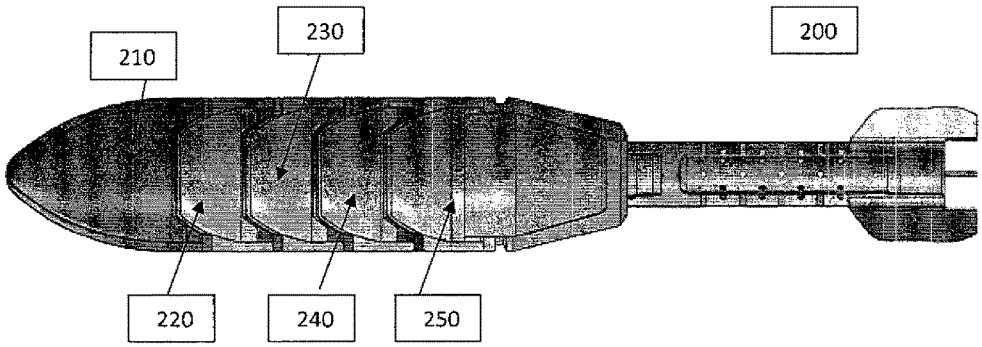
FIG. 3 illustrates a cutaway view of a stackable munition with collaborative engagement stacked projectiles according to this invention.
Figure 4:
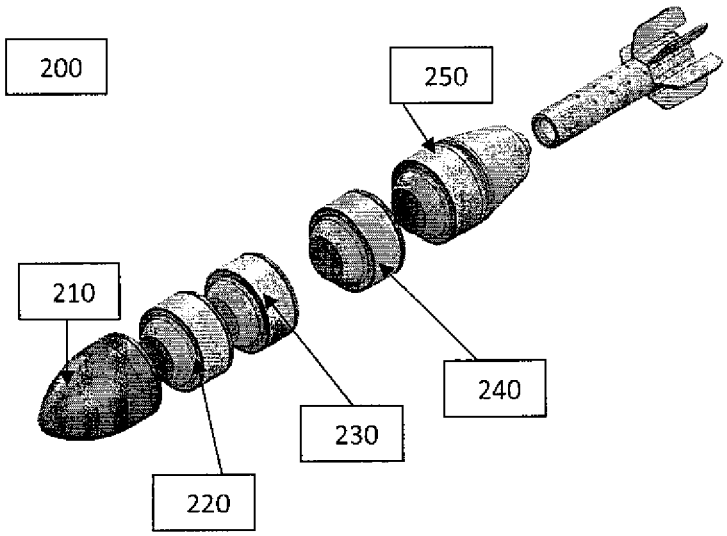
FIG. 4 illustrates a stackable munition with collaborative engagement stacked projectiles after gun launch according to this invention.
Figure 5:
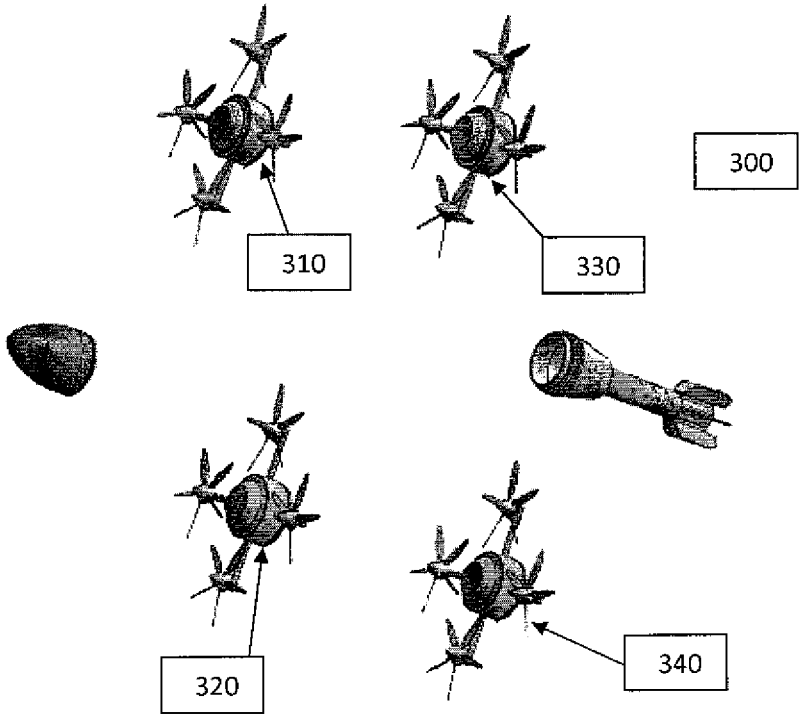
FIG. 5 illustrates a collaborative engagement stacked projectile transforming into self propelled projectiles according to this invention.
Figure 6:
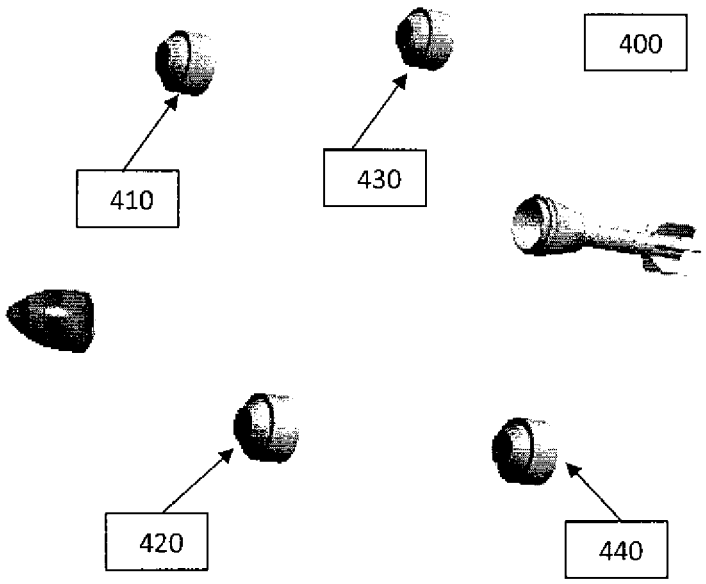
FIG. 6 illustrates a collaborative engagement stacked projectiles separating into a programmed pattern, according to this invention.

FIG. 2 is a model of 60 mm mortar stackable munition (200) with collaborative engagement stacked projectiles (210,220,230,240,250). The stackable munition (200) or stackable projectile (200) contains multiple collaborative engagement stacked projectiles (210,220,230,240,250), where each of the stacked projectiles (210,220,230,240,250) is an independent projectile which may have its own fuze, camera, energetic or other payload, autopilot, guidance navigation and control systems (GN&C), electronics, propulsion system, battery, flex circuits, antenna, and transmit/receiver devices, e.g., with real time broadcasting and receiving potential (above sections not completely shown). FIG. 3 is a cutaway view of a 60 mm mortar stackable munition or projectile (200) with collaborative engagement stacked projectiles (210,220,230,240,250). It is shown that the inside of each of the collaborative engagement stacked projectiles (210,220,230,240,250) has plenty of room for inclusion of fuze, camera, energetic or other payload, autopilot, guidance navigation and control system (GN&C), electronics, propulsion system, battery, flex circuits, antenna, and transmit/receiver devices (above sections not completely shown). FIG. 4 shows a stackable munition (200) with collaborative engagement stacked projectiles (210,220,230,240,250) separating after gun launch. The collaborative engagement stacked projectiles each contain a set-back pin (not shown). When stackable munition 200 for instance is fired, each of its set-back pins (not shown here) would be broken. As such munition 200 exits the gun, collaborative engagement stacked projectiles (210,220,230,240,250) each come apart as shown in FIG. 4. The munitions would then be independent projectiles each with its own capability to defeat its own target. They each would contain its own fuze, camera, energetic or other payload, autopilot, guidance navigation and control system (GN&C), electronics, battery, flex circuits, antenna, and transmit/receiver devices, e.g., (above sections not completely shown). A user (warfighter), at command and control, has the ability to view out from each of these projectiles due to a camera system mounted in the projectile (not shown) and broadcasting views therefrom in real time. The user has secure links (similar to the secure links on present day unmanned aerial vehicles) that can fly uninterrupted by an enemy, with only the user able to see the video transmitted real time. The user can see what the projectile sees on a PDA or computer previously set up to link with the stacked projectiles (210,220,230,240,250). Such user also has an option to designate-set one of the projectiles as a leader, and to have the other projectiles follow it to target, or to air burst, when desired. Each projectile may have a GN&C system (not shown) such as a canard activation system (CAS) that can allow each projectile to change, or to maintain course as it travels to the target. Such CAS can have canards and be linked to an autopilot that allows the canards to activate, thus to turn a projectile to left or right, up or down. These projectiles can only course change a few meters in either direction since they do not have a propulsion system once in flight. They can therefore be directed to attack one or more targets that are within the basket of their capability. They move along an aerodynamic flight path or paths, with minor corrections by the canards. The canards can add some extended range to the stacked projectiles (210,220,230,240,250), but such gains are limited to aerodynamic flight dynamics. FIG. 5 shows stacked projectiles (210,220,230,240,250) transforming into quad copters (310,320,330,340) or tricopters (not completely shown). The propellers, support shafts and motors are held inside a housing (not shown) of each stacked projectile (210,220,230,240,250). Once the propeller, support shaft, and/or motor is released from such housing while in flight, the projectiles transform into self-propelled munitions, as quad-copters (310,320,330,340) or as tri-copters (not completely shown). Such self-propelled copters (310,320,330,340) each has its own capability to defeat its own target. Each would contain its own fuze, camera, energetic or other payload, autopilot, guidance navigation and control system (GN&C), electronics, propulsion system, battery, flex circuits, antenna, and transmit/receiver devices, e.g., (above not completely shown). Many of these components may be miniaturized and put onto flex circuits, thus greatly reducing weight, size and cost. Such then would further allow inclusion of these components into projectiles, while leaving a space budget to fit all other aforementioned components as might be needed. Self-propelled quad copters (310,320,330,340) may control munition motion, whether up, down, right or left, by motor propeller maneuvering. Each self-propelled quad copter (310,320,330,340) or projectile can fly for 10-15 minutes, and up to 40 plus miles per hour (depending on projectile weight, batteries, and propellers as chosen). Each self-propelled quad copter (310,320,330,340) or projectile can now be directed or controlled by a user to swarm to a single target chosen and destroy that target, or to fly towards separate targets, and destroy those targets. Projectiles (310,320,330,340) may also be preprogrammed, in the autopilot of each projectile, to go towards or to destroy a target, with a present way-point or GPS location. The projectiles can also be programmed to have a leader-follower formation and go to the desired location controlled by a user during flight, utilizing a computer or PDA and camera on the projectile with a real time transmitting and receiving system. They also have the capability to hover for up to 10 minutes (depending on projectile weight, battery size and propeller motor system). Other collaborative engagement stacked projectiles 300 can be separately fired at the same time from other guns, and then be transformed into self-propelled projectiles (like 310,320, 330,340). They can also be directed to join as a swarm and engage targets as previously stated. In another embodiment, the inside or outside shape and weight of each of stacked projectile (410,420,430,440, e.g.) can be separately selected to allow each projectile to separate and fly into a preplanned pattern, as shown in FIG. 6. When such pattern or formation is achieved, the user can have the fuzes for all projectiles (410,420,430,440) activate to fire and thus produce an optimized fragmentation pattern. Several collaborative engagement stacked projectiles (400) can also be fired from different guns at the same time. The autopilots and CAS system can be set to have the stacked projectiles (410,420, 430, and 440) from each round 400 stay at a preprogrammed distance away from each other, and then create an even larger optimized fragmentation pattern. Collaborative engagement stacked projectiles (200, 300 and 400) can also be set up to accomplish many different missions carrying many different payloads and with many optimized swarming patterns. Such payloads could include but not be restricted to: flares, smoke, fragmentations, airbursts, warheads, hovering surveillance/reconnaissance, illumination, blasting and shaped charge jet payloads. All can work as a swarm, and different payloads can be utilized in the same mission to optimize a warfighter's capability. While a 60 mm mortar round was used as an example here, the same could be done with 40 mm grenade munitions, 81 mm and 120 mm mortars, and 105 mm and 120 mm artillery and cargo delivery systems, e.g., (the above not completely shown).

While the invention may have been described with reference to certain embodiments, numerous changes, alterations and modifications to the described embodiments are possible without departing from the spirit and scope of the invention as defined in the appended claims, and equivalents thereof.

What is claimed is:

1. A stacked, collaborative engagement mortar round comprising plural stacked miniaturized self-propelled projectiles wherein:

the stacked miniaturized self-propelled projectiles are interlocking discs which form a body of the mortar round including an outer surface of the body; and each of the projectiles further comprise a set-back pin which is broken upon the mortar round being fired thereby causing the projectiles to separate after launch and before an apogee point of the mortar round and then collaboratively swarm towards a target wherein there is ground processor interaction included to control said projectiles which may optionally be used to direct the projectiles to fly to a designated particular target.

2. The mortar round of claim 1 wherein said ground processor interaction is manned.

3. The mortar round of claim 2 wherein it is possible to change the original direction to fly the projectiles to a differently designated target.

4. The mortar round of claim 3 wherein it is possible to change the original directions to instead just perform surveillance by the projectiles.

5. The mortar round of claim 2 wherein it is possible to direct all the projectiles to transition into UAV units.

6. A stacked collaborative engagement mortar round comprising plural self-propelled stacked miniaturized projectiles wherein:

the stacked miniaturized projectiles are interlocking discs which form a body of the mortar round including an outer surface of the body; and each of the projectiles further comprises a set-back pin which is broken upon the mortar round being fired, thereby causing the projectiles to separate after launch and before an apogee point of the mortar round and then collaboratively swarm towards a target wherein each projectile has its own miniaturized guidance, navigation and control components, autopilot, cameras, transmitter, receiver, antennae, power source, sensors, fuzes and/or flex circuits.

7. The mortar round of claim 6 wherein the projectiles are mines which are dispersed by such round.

8. The round of claim 6 wherein the projectiles separate upon launch as plural munitions of which of said munitions deploy propeller units and with assist of such propeller units for navigation, swarm towards said target.

9. The round of claim 8 wherein all said munitions deploy propeller units.

10. The round of claim 9 wherein said propeller units are tri-copter type propeller units.

11. The round of claim 9 wherein said propeller units are quad-copter type propeller units.

12. The round of claim 9 wherein some of said propeller units are quad-copter type propeller units and some are tri-copter type propeller units.

13. The mortar round of claim 1 wherein there are plural targets for the said round.

* * * * *